US006966323B2

(12) United States Patent
Deiss et al.

(10) Patent No.: US 6,966,323 B2
(45) Date of Patent: Nov. 22, 2005

(54) GAS-HEATED DISHWASHER

(75) Inventors: Ulrich Deiss, Sontheim (DE); Ernst Stickel, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 13 days.

(21) Appl. No.: 10/813,385

(22) Filed: Mar. 29, 2004

(65) Prior Publication Data

US 2004/0194815 A1 Oct. 7, 2004

Related U.S. Application Data

(63) Continuation of application No. PCT/EP02/10256, filed on Sep. 12, 2002.

(30) Foreign Application Priority Data

Sep. 27, 2001 (DE) ..... 101 47 765

(51) Int. Cl.[7] ..... B08B 3/10

(52) U.S. Cl. ..... 134/57 D; 134/58 D; 134/107; 134/108; 134/184; 134/200

(58) Field of Search ..... 134/56 D, 57 D, 134/58 D, 105, 107, 108, 184, 200

(56) References Cited

U.S. PATENT DOCUMENTS

| | | | | |
|---|---|---|---|---|
| 3,104,669 A | | 9/1963 | Claywell | |
| 4,296,768 A | | 10/1981 | Saucedo | |
| 4,748,968 A | * | 6/1988 | Vrij | 126/100 |
| 5,511,570 A | * | 4/1996 | Noren et al. | 134/105 |
| 5,642,742 A | * | 7/1997 | Noren et al. | 134/57 D |
| 5,794,634 A | | 8/1998 | Noren et al. | |
| 6,109,339 A | * | 8/2000 | Talbert et al. | 165/48.1 |

FOREIGN PATENT DOCUMENTS

| | | |
|---|---|---|
| DE | 544 010 | 2/1932 |
| DE | 198 59 189 A1 | 6/2000 |
| EP | 0 000 192 A1 | 1/1979 |
| JP | 2000342506 A | 12/2000 |
| SU | 1101219 A | 7/1984 |

* cited by examiner

*Primary Examiner*—Joseph L Perrin
(74) *Attorney, Agent, or Firm*—John T. Winburn; Russell W. Warnock; Craig J. Loest

(57) ABSTRACT

A gas-heated dishwasher includes a gas burner for heating the rinsing liquid and drying dishes, which is suitable for drying dishes and heating the rinsing liquid in an efficient way, while, at the same time, making it possible for a worktop to be placed on top of the dishwasher, the gas burner is embodied and disposed in the motor chamber so that it heats at least one closed tubular heating body filled with a fluid during a sub-program dry section and heats the rinsing fluid during the sub-program sections when the rinsing fluid is used.

19 Claims, 2 Drawing Sheets

GAS-HEATED DISHWASHER

CROSS-REFERENCE TO RELATED APPLICATION

This application is a continuation, under 35 U.S.C. §120, of copending international application No. PCT/EP02/10256, filed Sep. 12, 2002, which designated the United States; this application also claims the priority, under 35 U.S.C. §119, of German patent application No. 101 47 765.1, filed Sep. 27, 2001; the prior applications are herewith incorporated by reference in their entirety.

BACKGROUND OF THE INVENTION

Field of the Invention

The invention relates to a gas-heated dishwasher having a gas burner for heating the rinsing liquid and for drying the items being rinsed.

German Patent DE 544 010 discloses a dishwashing apparatus having a washing and rinsing liquid container and having a stationary washing basket, in which the rinsing liquid is heated through a gas burner located underneath it to a high temperature during the washing process, with the items being rinsed being dried indirectly by the heating of the rinsing liquid. For such a purpose, the dishwashing apparatus has a washing liquid container and a rinsing liquid container, with the washing liquid container being heated indirectly through the rinsing liquid container. The heating of the rinsing liquid container results in hot air rising upwards, thus, contributing to the drying of the items being rinsed. It has been found to be disadvantageous with this dishwashing apparatus that a relatively large amount of liquid is consumed, and heat is intended to be transported only through the air to dry the wetted items being rinsed.

U.S. Pat. No. 3,104,669 to Claywell discloses a gas-heated dishwasher in which the gas burner is disposed in the motor area and the air that is located in a tube loop is heated. Because the gas burner is disposed within the tube system, it heats the air that is located therein, which, itself, heats the tube surface in order, thus, to speed up the drying process in the rinsing container. For such a purpose, the substantially horizontally disposed tube loop in the motor area in which the gas burner is disposed leads to the rear wall of the dishwasher, where it opens into a shaft that is open at the top and that runs substantially diagonally on the rear wall of the dishwasher, in order in this way to provide as large a surface area as possible towards the rinsing container. Due to the gas burner, which is disposed in the tube loop, the exhaust gases that are produced by the combustion of the gas can be dissipated to the outside through the tube loop. This is done through the airshaft that runs substantially diagonally on the rear wall and is open at its upper end, that is to say, the working surface of the dishwasher. The use of an exhaust gas tube that is disposed in the rear area of a work surface will be regarded as being disadvantageous just from obvious reasons relating to practicality and safety. The efficiency of a gas burner that heats only a tube system that is filled with air in order in this way to reduce the drying time of items being rinsed is, likewise, very low.

SUMMARY OF THE INVENTION

It is accordingly an object of the invention to provide a gas-heated dishwasher that overcomes the herein aforementioned disadvantages of the heretofore-known devices of this general type and that is suitable both for drying the items being rinsed and for heating the rinsing liquid in an efficient manner, with the aim of providing the capability to provide a working surface above the dishwasher.

With the foregoing and other objects in view, there is provided, in accordance with the invention, a dishwasher for cleaning items during a cleaning program having sections, including rinsing and drying sections, and for conveying a rinsing liquid, the dishwasher including a housing defining a motor area, at least one closed tubular heating body filled with a fluid, and a gas burner for heating the rinsing liquid and for drying rinsed items, the gas burner being disposed in the motor area, heating the heating body during the drying section, and heating the rinsing liquid during a section of the program in which rinsing liquid is used.

With the objects of the invention in view, there is also provided a dishwasher for cleaning items, including a housing defining a motor area, a controller disposed at the housing and being programmed to execute a cleaning program including at least a rinsing mode, in which a rinsing liquid is conveyed to the items, and a drying mode, at least one closed tubular heating body filled with a fluid, the heating body being disposed in the housing, a gas burner disposed in the motor area in heat-conducting contact with the heating body and being connected to the controller and controlled thereby to heat the rinsing liquid and to dry rinsed items, and the controller programmed to control the gas burner to heat the heating body during the drying mode and control the gas burner to heat the rinsing liquid during a mode of the program in which the rinsing liquid is used.

The dishwasher according to the invention has a gas burner disposed therein, which is used for heating the rinsing liquid and for drying the items being rinsed. The gas burner is configured and disposed in the motor area such that it heats at least one closed tubular heating body, which is filled with a fluid, during a program section element "drying" and heats the rinsing liquid during the program section elements in which rinsing liquid is used.

In accordance with another feature of the invention, the closed tubular heating body, which is filled with a fluid, for example, a liquid or a gas, is protected against frost by a frost protection device when using a liquid as the fluid.

During the heating of the fluid, the fluid is transported within the closed tubular heating body by virtue of the temperature differences that are formed; although, however, it may also be advantageous to integrate a dedicated pump for transport of the fluid in the closed tubular heating body to assist the circulation of the fluid.

The closed tubular heating body, which is filled with a fluid, is, advantageously, heated only during the program section element "drying", although it may also be advantageous to heat the closed tubular heating body, which is filled with a fluid, throughout the entire rinsing program.

To achieve drying that is as efficient as possible during the program section element "drying", it is expedient to configure the closed tubular heating body, which is filled with a fluid, such that as large an area of the tubular heating body as possible is adjacent to one wall of the rinsing container. The closed tubular heating body that is filled with a fluid advantageously has a meandering shape and is disposed in one side wall or in the rear wall of the dishwasher. The closed tubular heating body that is filled with fluid expediently extends from the side wall or rear wall at least in places as far as the motor area of the dishwasher, in which the gas burner is disposed. Thus, to improve the drying effect, the closed tubular heating body that is filled with fluid has as large a surface area as possible to make it possible to emit the energy that is stored therein as quickly as possible to the atmosphere in the rinsing container. The energy is used to heat the atmosphere in the rinsing container to make it possible to absorb the moisture that is adhering to the items being rinsed.

In accordance with a further feature of the invention, sections of the closed tubular heating body that is filled with fluid and supply lines for the rinsing liquid are joined together in a heat exchanger that is heated by the gas burner.

In accordance with an added feature of the invention, an electrical power supply, preferably, a rechargeable battery, is provided in the bottom area of the dishwasher and can supply as least as much electrical energy to provide the necessary power to carry out the rinsing program, and to drive and operate the pumps etc. for a rinsing program procedure.

In accordance with an additional feature of the invention, the rechargeable battery is, advantageously, charged continuously, provided that it is connected to an electrical power supply and the supply allows charging.

In accordance with a concomitant feature of the invention, the dishwasher is configured such that a rinsing process is not ready to be started until a signal from the rechargeable battery enables the start command from the user, depending on the state of charge of the rechargeable battery. Fundamentally, it is necessary to ensure that the entire rinsing program can be completed with the stored energy.

In one particularly preferred embodiment in the present invention,

The dishwasher according to the invention has the advantages that the use of gas considerably reduces the electrical energy that is required, thus, improving the efficiency at least in some countries or regions. Furthermore, the dishwasher according to the invention has been found to be advantageous in countries and regions whose electrical mains power supply is not always reliably available, or can be used in contingency periods only at specific times of the day or night.

Other features that are considered as characteristic for the invention are set forth in the appended claims.

Although the invention is illustrated and described herein as embodied in a gas-heated dishwasher, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
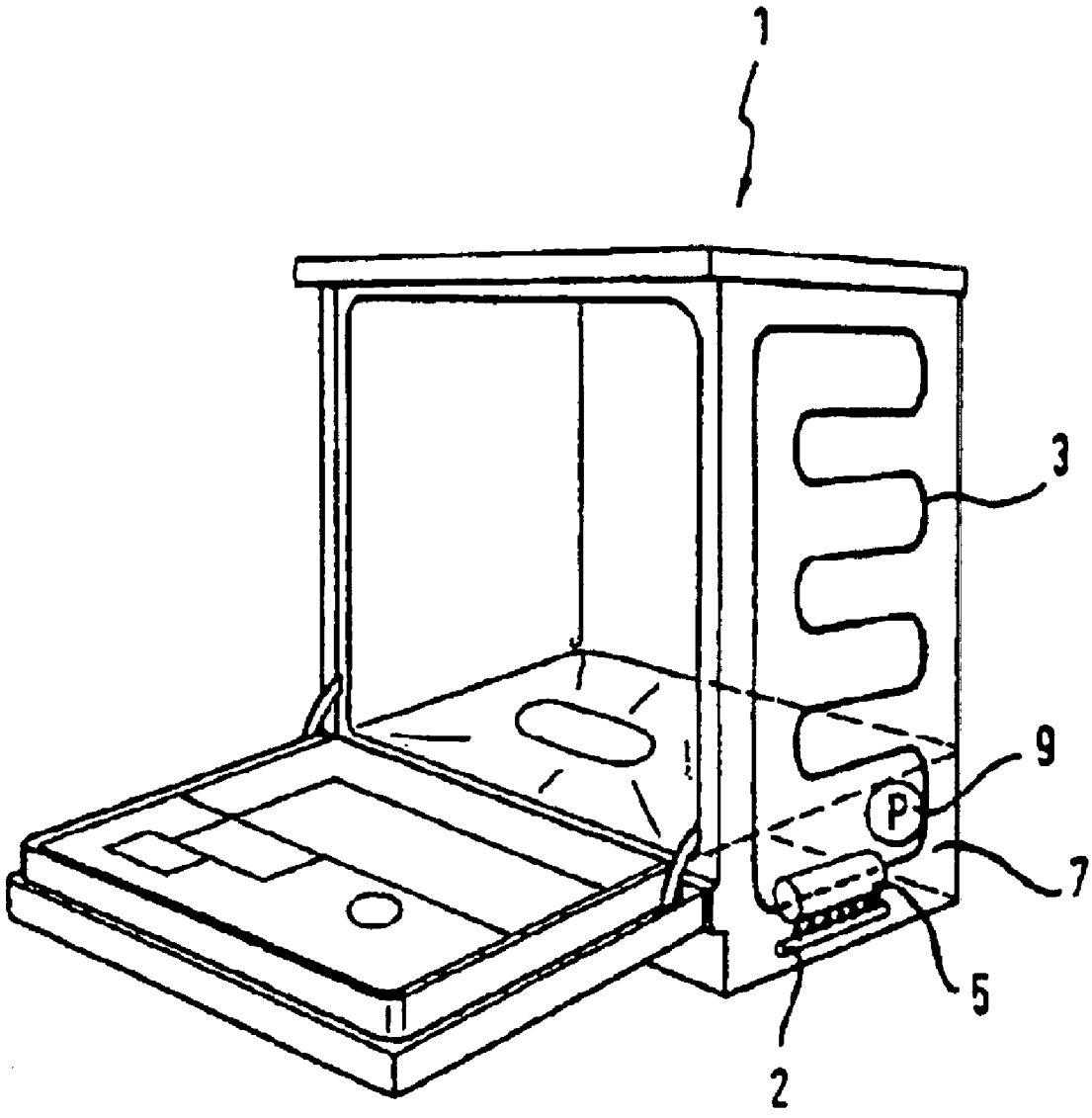
FIG. 1 is a perspective and partially hidden view of a dishwasher according to the invention with rinsing liquid lines not shown.

Referring now to the figures of the drawings in detail and first, particularly to FIG. 1 thereof, there is shown a dishwasher 1 that has a meandering tubular heating body 3 in its left-hand side wall, having a pump 9 that is operatively connected through a gas burner 2 and a heat exchanger 5 that is disposed immediately thereabove. The dishwasher 1 defines a motor area 7. Depending on the program section of the rinsing program, the gas burner 2 is started through an electrical or mechanical signal to heat, in the heat exchanger 5 that is located above it, a fluid that is located in the closed tubular heating body 3, for example, a liquid or a gas. The fluid is, expediently, moved in a circulating manner in the closed tubular heating body 3 through the pump 9.

Figure 2:
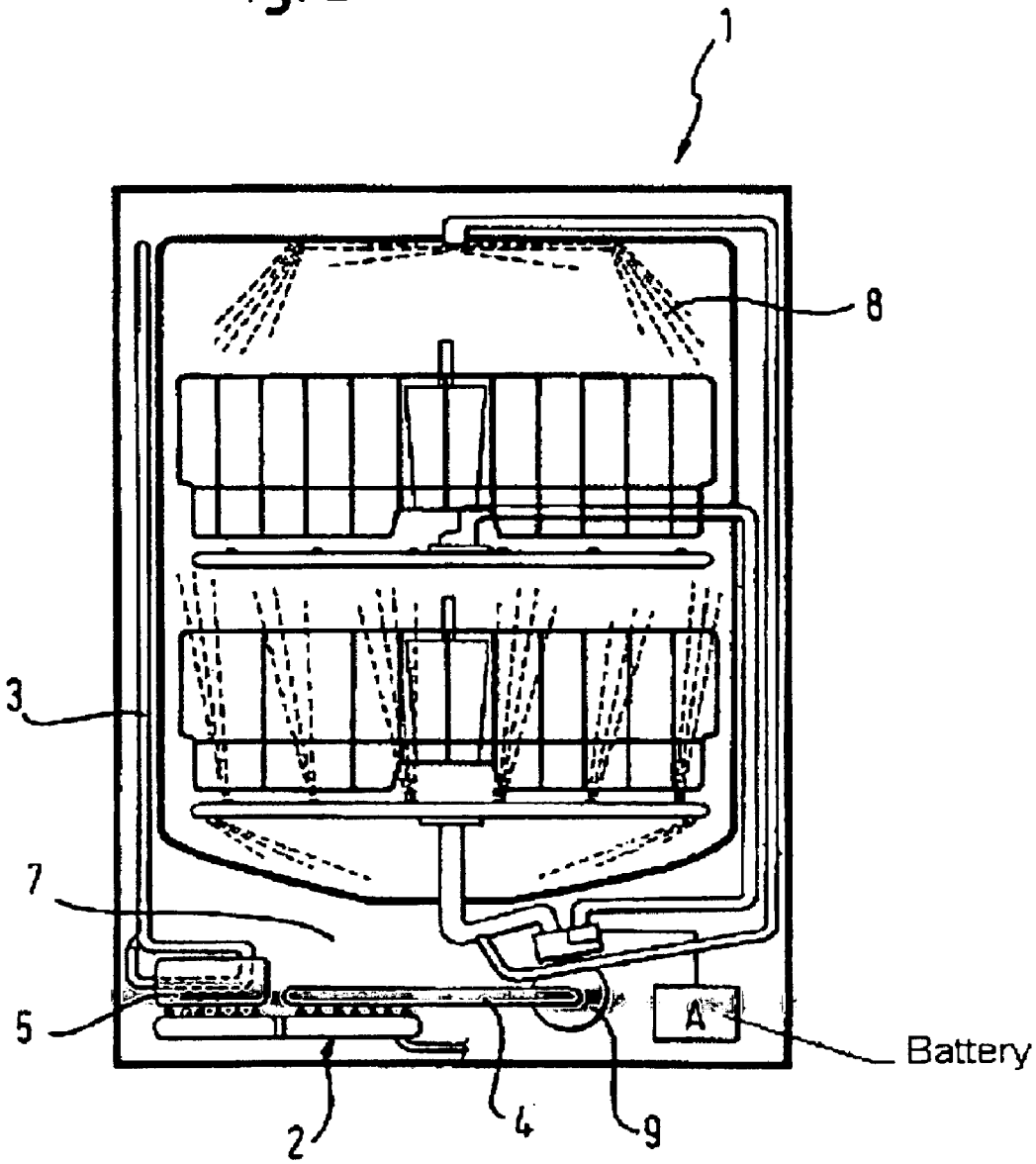
FIG. 2 is a cross-sectional view of a dishwasher according to the invention in which only a closed tubular heating body is heated by a heat exchanger.

The configuration in FIG. 2 shows one preferred embodiment of the present dishwasher 1 according to the invention, in which the supply line 4 that is provided for transportation of the rinsing liquid 8 is heated by the gas burner 2. The heated rinsing liquid is transported through a pump 9 to the respective areas of the rinsing container, and is inserted through spraying arms there corresponding to the respective program section element of the rinsing program. The gas burner 2, advantageously, has an area that can be electrically or mechanically driven in accordance with the respective program stage, and that heats the fluid in the closed tubular heating body 3 through a heat exchanger 5. Due to the laws of physics, the heated fluid starts to circulate in the closed tubular heating body 3, thus, making it possible to produce a heat distribution that is substantially in equilibrium within the tubular heating body 3. The closed tubular heating body 3 that is filled with fluid is, expediently, disposed directly adjacent to the rinsing container so that the rinsing container wall that is heated in this way heats the atmosphere in the rinsing container, thus, advantageously influencing the drying during the program section element "drying".

An electrical power supply, in the illustrated exemplary embodiment, a rechargeable battery A, is, advantageously, provided in the dishwasher 1 according to the invention and supplies at least the amount of electrical energy that is required for starting the gas burner 2, for controlling the rinsing program, and for controlling and rotating the pumps, this being the electrical energy that is required for carrying out at least one rinsing program. The rechargeable battery A is continuously charged in a particularly advantageous manner, provided that electrical power is available for charging from an external power supply.

In one embodiment of the present invention, which is not illustrated, the dishwasher 1 is configured such that a rinsing program is not ready to be started until a signal from the rechargeable battery A enables the start command from the user, depending on the state of charge of the rechargeable battery A, in which case it is necessary to ensure that the entire rinsing program can be completed with the stored energy.

The dishwasher 1 according to the invention has the advantages that the use of gas considerably reduces the electrical energy that is required, thus, improving the efficiency, at least in some countries or regions. Furthermore, the dishwasher 1 according to the invention has been found to be advantageous in countries and regions whose electrical power supply system is not always reliably available or can be used in contingency periods only at specific times of the day or night.

We claim:

1. A dishwasher for cleaning items, comprising:

a washing and rinsing liquid container;

a motor area outside of said washing and liquid container;

a housing enclosing said motor area;

a controller disposed at said housing and being programmed to execute a cleaning program including at least a rinsing mode, in which a rinsing liquid is conveyed to the items, and a drying mode;

at least one closed tubular heating body filled with a fluid, said heating body being disposed in said housing;

a gas burner disposed in said motor area in heat-conducting contact with said heating body and being connected to said controller and controlled thereby to heat the rinsing liquid and to dry rinsed items; and said controller programmed to:

control said gas burner to heat said heating body during said drying mode; and control said gas burner to heat the rinsing liquid during a mode of said program in which the rinsing liquid is used.

2. The dishwasher according to claim 1, further comprising a frost-protection device protecting said heating body against frost when said fluid is a liquid.

3. The dishwasher according to claim 1, further comprising a means for protecting said heating body against frost when said fluid is a liquid.

4. The dishwasher according to claim 1, further comprising a pump fluidically connected to said heating body and circulating said fluid through said heating body.

5. The dishwasher according to claim 1, wherein said heating body is heated only during the drying section.

6. The dishwasher according to claim 1, wherein:

said housing has a side wall and a rear wall; and said heating body is disposed in at least one of said side wall and said rear wall.

7. The dishwasher according to claim 6, wherein said heating body has a meandering shape.

8. The dishwasher according to claim 6, wherein a section of said heating body extends as far as said motor area.

9. The dishwasher according to claim 8, further comprising:

a heat exchanger heated by said gas burner;

supply lines for supplying the rinsing liquid; and said heating body and said supply lines being joined together in said heat exchanger.

10. The dishwasher according to claim 1, wherein a section of said heating body extends as far as said motor area.

11. The dishwasher according to claim 10, further comprising:

a heat exchanger heated by said gas burner;

supply lines for supplying the rinsing liquid; and said heating body and said supply lines being joined together in said heat exchanger.

12. The dishwasher according to claim 1, wherein said heating body has a meandering shape.

13. The dishwasher according to claim 1, further comprising:

a heat exchanger heated by said gas burner;

supply lines for supplying the rinsing liquid; and said heating body and said supply lines being joined together in said heat exchanger.

14. The dishwasher according to claim 1, further comprising:

pumps; and an electrical power supply connected to said pumps and said gas burner and supplying at least an amount of electrical energy required for starting said gas burner, for controlling said rinsing section of said program, for open-loop and closed-loop control of said pumps, and for carrying out said rinsing section.

15. The dishwasher according to claim 14, wherein said energy supply is at least one rechargeable battery.

16. The dishwasher according to claim 15, wherein said rechargeable battery is charged continuously.

17. The dishwasher according to claim 15, wherein said rechargeable battery is charged continuously provided that electrical power for charging is available from an external power supply.

18. The dishwasher according to claim 15, wherein:

said rechargeable battery provides a signal dependent upon a state of charge of said rechargeable battery; and said rinsing section does not start until said signal enables a start command from a user.

19. The dishwasher according to claim 15, wherein:

said rechargeable battery provides a signal dependent upon a state of charge of said rechargeable battery; and said rinsing section does not start until said signal indicates a predefined state of said rechargeable battery.

* * * * *